US006630790B2

(12) United States Patent
Kanazawa et al.

(10) Patent No.: US 6,630,790 B2
(45) Date of Patent: Oct. 7, 2003

(54) PLASMA DISPLAY DEVICE WITH REDUCED DISPLAY DEFECTS

(75) Inventors: Yoshikazu Kanazawa, Kawasaki (JP); Seiki Kuroki, Higashimorokata (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/929,365

(22) Filed: Aug. 15, 2001

(65) Prior Publication Data

US 2002/0053875 A1 May 9, 2002

(30) Foreign Application Priority Data

Nov. 8, 2000 (JP) ..... 2000-341095

(51) Int. Cl.[7] ..... H01J 17/49

(52) U.S. Cl. ..... 313/584; 313/585; 313/582; 345/67

(58) Field of Search ..... 313/582–587; 315/169.4; 345/60, 67; 349/39

(56) References Cited

U.S. PATENT DOCUMENTS 6,259,494 B1 * 7/2001 Kawai et al. ..... 349/39
6,373,452 B1 * 4/2002 Ishii et al. ..... 345/67
6,414,656 B1 * 7/2002 Hong ..... 345/60

FOREIGN PATENT DOCUMENTS

| | | | |
|---|---|---|---|
| EP | 1 032 015 A2 | 8/2000 | |
| JP | 9-160525 | 6/1997 | |
| JP | 2000-251739 | 9/2000 | |
| JP | 2002075219 A * | 3/2002 | ..... H01J/11/02 |

* cited by examiner

*Primary Examiner*—Nimeshkumar D. Patel
*Assistant Examiner*—Karabi Guharay
(74) *Attorney, Agent, or Firm*—Staas & Halsey LLP

(57) ABSTRACT

A plasma display device includes: first and second substrates sandwiching a discharge gas therebetween; a plurality of first and second electrodes arranged alternately on the first substrate to extend in a first direction; a plurality of third electrodes arranged on the second substrate to extend in a second direction perpendicular to the first direction; display cells formed between the first and second electrodes along the third electrodes; first and second discharge electrode parts extending from the first and second electrodes toward the second and first electrodes in the display cells, respectively; and first and second auxiliary electrodes connecting the first and second electrodes with tip parts of the first and second discharge electrode parts, respectively. The display cells include first and second display cells. The first display cells include the first and second auxiliary electrodes, and the second display cells each lack at least one of the first and second auxiliary electrodes.

9 Claims, 14 Drawing Sheets

PLASMA DISPLAY DEVICE WITH REDUCED DISPLAY DEFECTS

BACKGROUND OF THE INVENTION

1. Field of the Invention

The present invention generally relates to flat-panel display devices, and more particularly to a plasma display device.

A plasma display device is a flat-panel display device of a light-emitting type that displays picture information by selectively inducing discharges in a gas filled between a pair of glass substrates.

It is important for the plasma display device to increase resolution and reduce power consumption at the same time.

2. Description of the Related Art

FIG. 1 is a diagram showing a basic structure of a conventional common plasma display device 10.

The plasma display device 10 is basically defined by a display panel 11 and first through third driving circuits 12A through 12C that cooperate with the display panel 11. The display panel 11 includes first discharge electrodes $X_1$ through $X_m$ and second discharge electrodes $Y_1$ through $Y_m$ that are alternately arranged parallel to each other and extend in the X direction of FIG. 1. Further, the display panel 11 includes address electrodes $A_1$ through $A_n$ that extend in the Y direction of FIG. 1 to intersect the first and second discharge electrodes $X_1$ through $X_m$ and $Y_1$ through $Y_m$. The first discharge electrodes $X_1$ through $X_m$, the second discharge electrodes $Y_1$ through $Y_m$, and the address electrodes $A_1$ through $A_n$ are selectively activated by the first through third driving circuits 12A through 12C, respectively.

For instance, an address voltage is applied between a selected one of the first discharge electrodes $X_1$ through $X_m$ ($X_2$ in FIG. 1) and a selected one of the address electrodes $A_1$ through $A_n$ ($A_4$ in FIG. 1), so that a discharge is started between the first discharge electrodes $X_2$ and the address electrode $A_4$. Next, by applying a discharge-sustaining voltage between the first discharge electrodes $X_2$ and the adjacent second discharge electrode $Y_2$ by the driving circuits 12A and 12B, a discharge is started between the first discharge electrodes $X_2$ and the second discharge electrode $Y_2$ in a display cell selected by the address electrode $A_4$. The discharge is maintained while the selected display cell is activated.

It is required for such a plasma display device to increase resolution by narrowing pitches between electrodes and reduce power consumption at the same time.

FIG. 2 is a sectional view of the conventional plasma display panel 11, whose type is referred to as an ALIS (Alternate Lighting of Surfaces) type, taken along the Y direction of FIG. 1. This type of plasma display panel is disclosed in Japanese Patent No. 2801893.

The display panel 11 of FIG. 2 is defined by glass substrates 11A and 11B opposed to each other, and a discharge gas is filled between the glass substrates 11A and 11B.

The glass substrate 11A may be referred to as a front or display-side substrate facing a viewer of the display panel 11, and the glass substrate 11B may be referred to as a rear substrate provided across the glass substrate 11A from the viewer.

More specifically, the glass substrate 11A has the first and second discharge electrodes $X_1$ through $X_m$ and $Y_1$ through $Y_m$ alternately arranged with the same pitch on its side opposing the glass substrate 11B. The glass substrate 11B has the address electrodes $A_1$ through $A_n$ formed on its side opposing the glass substrate 11A. The first and second discharge electrodes $X_1$ through $X_m$ and $Y_1$ through $Y_m$ are formed of a transparent conductive film of ITO ($In_2O_3.SnO_2$), and the first discharge electrodes $X_1$ through $X_m$ (ITO electrodes) has low-resistance bus electrodes $x_1$ through $x_m$ formed thereon, respectively. Similarly, the second discharge electrodes $Y_1$ through $Y_m$ (ITO electrodes) has low-resistance bus electrodes $y_1$ through $y_m$ formed thereon, respectively. On the other hand, the address electrodes $A_1$ through $A_n$ are formed of low-resistance metal patterns to extend in a direction to cross a direction in which the bus electrodes $x_1$ through $x_m$ or $y_1$ through $y_m$ extend. The first and second discharge electrodes $X_1$ through $X_m$ and $Y_1$ through $Y_m$ and the bus electrodes $x_1$ through $x_m$ or $y_1$ through $y_m$ are covered with a dielectric film 11*a* on the glass substrate 11A, and the address electrodes $A_1$ through $A_n$ are covered with a dielectric film 11*b* on the glass substrate 11B. Further, as is not shown in the drawing, phosphor patterns of red, green, and blue are applied and formed on the dielectric film 11*b* in accordance with display pixels.

In the display panel 11 of the above-described structure, discharges caused between the glass substrates 11A and 11B excite the phosphor patterns to produce light, which is emitted through the glass substrate 11A as indicated by arrow in FIG. 2.

FIGS. 3(A) and 3(B) are plan views of patterns of the first and second discharge electrodes $X_1$ through $X_m$ and $Y_1$ through $Y_m$ formed on the glass substrate 11A in another conventional ALIS-type plasma display device including the display panel 11. The X and Y directions of FIGS. 3(A) and 3(B) correspond to those of FIG. 1.

According to FIG. 3(A), the first and second discharge electrodes $X_1$ through $X_m$ and $Y_1$ through $Y_m$ are formed of series of repeated T-shaped ITO patterns (electrodes) XT and YT extending from longitudinal sides of the corresponding bus electrodes $x_1$ through $x_m$ and $y_1$ through $y_m$ on the glass substrate 11A, respectively. Each ITO pattern has a tip part $T_A$ of a width A that extends in the extending direction of the bus electrodes $x_1$ through $x_m$ or $y_1$ through $y_m$ and a narrow neck part $T_B$ connecting the tip part $T_A$ and a corresponding one of the bus electrodes $x_1$ through $x_m$ or $y_1$ through $y_m$. Each adjacent ITO patterns are arranged with a pitch corresponding to the resolution of the display panel 11, for instance, a pitch of 300 $\mu$m in FIG. 3(A), and a discharge is sustained in a gap (discharge gap) of a width g formed between each opposed ITO patterns XT and YT.

FIG. 4 is a diagram showing a structure of the glass substrate 11B of FIG. 2.

According to FIG. 4, ribs 11C are formed with given pitches on the glass substrate 11B to extend in the Y direction of FIG. 1. Grooves $G_1$ through $G_n$ are formed between the ribs 11C, and the address electrodes $A_1$ through $A_n$ are formed in the corresponding grooves $G_1$ through $G_n$. Further, the address electrodes $A_1$ through $A_n$ are covered with the dielectric film 11*b* in the corresponding grooves $G_1$ through $G_n$, and the phosphor patterns R, G, and B of red, green, and blue, respectively, are formed on the dielectric film 11*b*.

The glass substrate 11B of FIG. 4 is reversed to be placed on the glass substrate 11A so that, as shown in FIG. 5, the grooves $G_1$ through $G_n$ formed between the ribs 11C contain the corresponding ITO patterns XT and YT. In FIG. 5, the ribs 11C are indicated by broken lines for easy understanding of the drawing.

Thus, the plasma display device having the electrode structure of FIG. 3 can reduce power consumption and a driving voltage by employing the T-shaped discharge electrode patterns XT and YT. However, since the ITO film forming the discharge electrode patterns XT and YT has a thickness of 1 $\mu$m or less, any discharge electrode pattern XT or YT can be broken by slight unevenness of the surface of the glass substrate 11A as indicated by a circle in FIG. 5. Such breakage prevents a desired cell from emitting light, thus resulting in a defective display.

Therefore, in order to secure a normal display even in the case of such breakage of any discharge electrode pattern XT or YT, the inventors of the present invention have proposed in Japanese Laid-Open Patent Application No. 2000-251739 auxiliary electrodes P to be provided, in the case of FIG. 5, to the bus electrodes $x_1$, $x_2$, $y_1$ and $y_2$ so as to extend to the tip parts TA of the discharge electrode patterns XT and YT. By providing the auxiliary electrodes P, even if the neck part TB of the discharge electrode pattern XT is broken as shown in FIG. 5, a desired discharge voltage can be supplied via the auxiliary electrode P from the bus electrodes $x_1$ to the T-shaped tip part TA of the discharge electrode pattern XT.

FIG. 6 shows another auxiliary electrode Q.

According to FIG. 6, the auxiliary electrodes Q stem from the bus electrodes $x_1$, $x_2$, $y_1$, and $y_2$ to extend along the neck parts TB of the discharge electrode patterns XT and YT. If the neck part TB of the discharge electrode pattern YT is broken as indicated by a circle in FIG. 6, a driving voltage is supplied via the auxiliary electrode Q from the bus electrode $y_2$ to the tip part TA of the discharge electrode pattern YT. However, since the auxiliary electrodes Q of FIG. 6 are formed in the light-emitting parts of display cells, the brightness of the plasma display panel 11 is reduced. In this point of view, the auxiliary electrode P of FIG. 5 is preferable to the auxiliary electrode Q of FIG. 6.

FIGS. 7(A) and 7(B) are schematic diagrams each showing a discharge caused in a cell in a plasma display panel including the T-shaped discharge electrode patterns XT and YT. FIG. 7(A) shows the discharge caused in the plasma display panel shown in FIG. 3 which panel includes no auxiliary electrodes P and Q, while FIG. 7(B) shows the discharge caused in the plasma display panel shown in FIG. 5 which panel includes the auxiliary electrodes P.

By comparing FIGS. 7(A) and 7(B), it can be seen that a discharge area is substantially larger with the auxiliary electrodes P in FIG. 7(B) than in FIG. 7(A). This is attributed to an increase in a discharge current which increase is caused by an increase in an effective electrode area which increase results from the formation of the auxiliary electrodes P.

Such an increase in the discharge current increases electrical connection between neighboring cells in the same groove with the result that charged particles, particularly, electrons, may diffuse to and accumulate in neighboring cells. If the electrons thus diffuse to and accumulate in the neighboring cells, residual ions accumulate in a selected cell so that a consequent potential difference may cause a large-scale giant electric discharge across a plurality of neighboring cells as shown in FIG. 8. Such a giant electric discharge may be caused without the formation of the auxiliary electrodes P, but the formation thereof increases the risk of such an uncontrollable giant electric discharge without doubt.

Further, if the ribs 11C includes a defective one as shown in FIG. 9, charged particles generated in a selected cell can diffuse to a neighboring cell separated by the defective rib 11C through a defect thereof and may cause an uncontrollable abnormal discharge in the neighboring cell. These discharges are visually recognized as display defects.

SUMMARY OF THE INVENTION

It is a general object of the present invention to provide a novel and useful plasma display panel in which the above-described disadvantages are eliminated.

A more specific object of the present invention is to provide a plasma display device free of display defects resulting from a defective discharge electrode and an abnormal discharge by means of auxiliary electrodes.

The above objects of the present invention are achieved by a plasma display device including: first and second substrates sandwiching a discharge gas therebetween; a plurality of first and second electrodes arranged alternately on the first substrate to extend in a first direction; a plurality of third electrodes arranged on the second substrate to extend in a second direction perpendicular to the first direction; display cells formed between the first and second electrodes along the third electrodes; first and second discharge electrode parts extending from the first and second electrodes toward the second and first electrodes in the display cells, respectively; and first and second auxiliary electrodes connecting the first and second electrodes with tip parts of the first and second discharge electrode parts, respectively, wherein the display cells include first and second display cells, the first display cells including the first and second auxiliary electrodes, the second display cells each lacking at least one of the first and second auxiliary electrodes.

According to the above-described plasma display device, a giant abnormal electric discharge apt to occur in a plasma display panel having T-shaped discharge electrodes and bus electrodes connected by auxiliary electrodes is prevented effectively by forming and dispersing display cells without the auxiliary electrodes in a plasma display panel. A discharge area in a display cell without the auxiliary electrodes P is smaller than in a display cell with the auxiliary electrodes P. Consequently, the spread of the giant abnormal discharge from cell to cell is prevented by forming such a display cell without the auxiliary electrodes P.

The above objects of the present invention are also achieved by a plasma display device including: first and second substrates sandwiching a discharge gas therebetween; a plurality of first and second electrodes arranged alternately on the first substrate to extend in a first direction; a plurality of third electrodes arranged on the second substrate to extend in a second direction perpendicular to the first direction; display cells formed between the first and second electrodes along the third electrodes; first and second discharge electrode parts extending from the first and second electrodes toward the second and first electrodes in the display cells, respectively; first and second auxiliary electrodes connecting the first and second electrodes with tip parts of the first and second discharge electrode parts, respectively; and partition walls formed on the second substrate and separating arrays of the display cells in the second direction from one another, the partition walls having their thicknesses increased in specified ones of the display cells, wherein the display cells include first and second display cells, the first display cells including the first and second auxiliary electrodes, the second display cells each lacking at least one of the first and second auxiliary electrodes, and the third electrodes are formed in spaces partitioned by the partition walls.

According to the above-described plasma display device, the same effects as described above can be produced.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description will now be given, with reference to the accompanying drawings, of embodiments of the present invention.

First Embodiment

Figure 10:
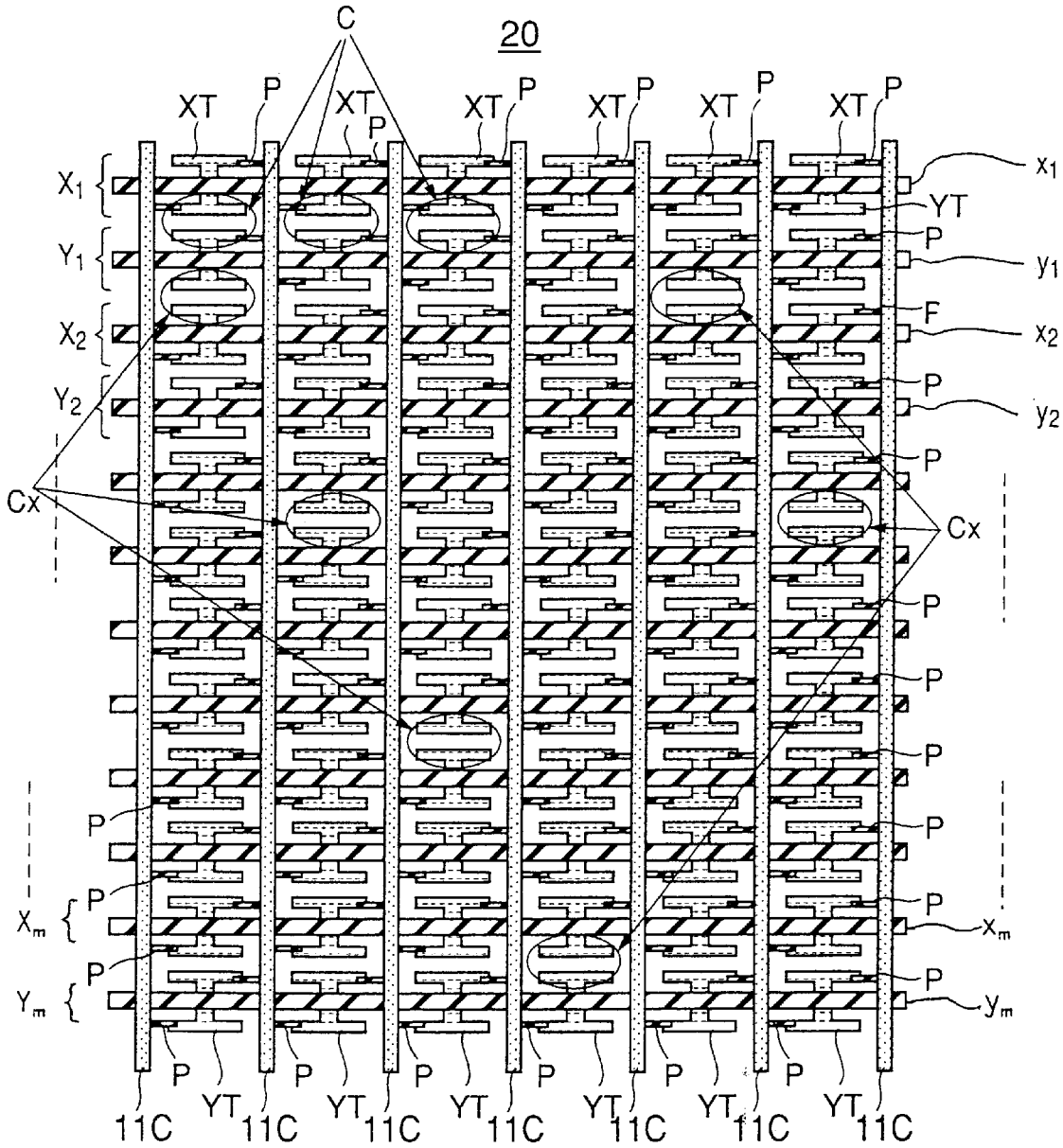
FIG. 10 is a diagram showing a structure of a plasma display device according to a first embodiment of the present invention.

FIG. 10 is a diagram showing a structure of a plasma display device 20 according to a first embodiment of the present invention. In FIG. 10, elements corresponding to those previously described are referred to by the same numerals, and a description thereof will be omitted.

The plasma display device 20 includes the plasma display panel 11 defined by the front and rear glass substrates 11A and 11B and the discharge gas filled therebetween as previously described. The discharge electrode patterns XT and YT and the bus electrodes $x_1$ through $x_m$ and $y_1$ through $y_m$ of FIG. 10 are formed on the front glass substrate 11A. That is, FIG. 10 is a plan view of the front glass substrate 11A.

Figure 4:
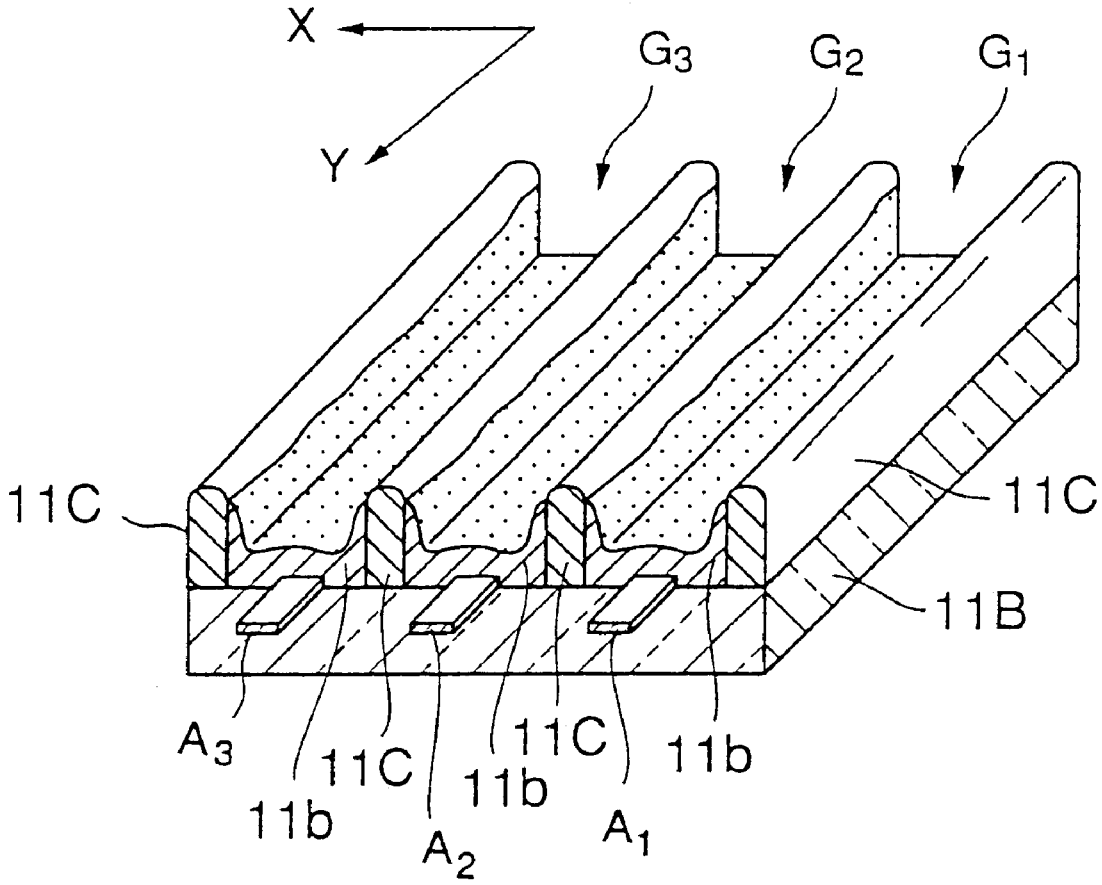
FIG. 4 PRIOR ART
FIG. 4 is a diagram showing a structure of a rear glass substrate of the plasma display device of FIGS. 3(A) and 3(B)

On the other hand, the numerous ribs (partition walls) 11C shown in FIG. 4 are formed parallel to one another on the rear glass substrate 11B, and address electrodes $z_1$ through $z_n$ are formed in corresponding spaces each formed between the neighboring ribs 11C.

Figure 5:
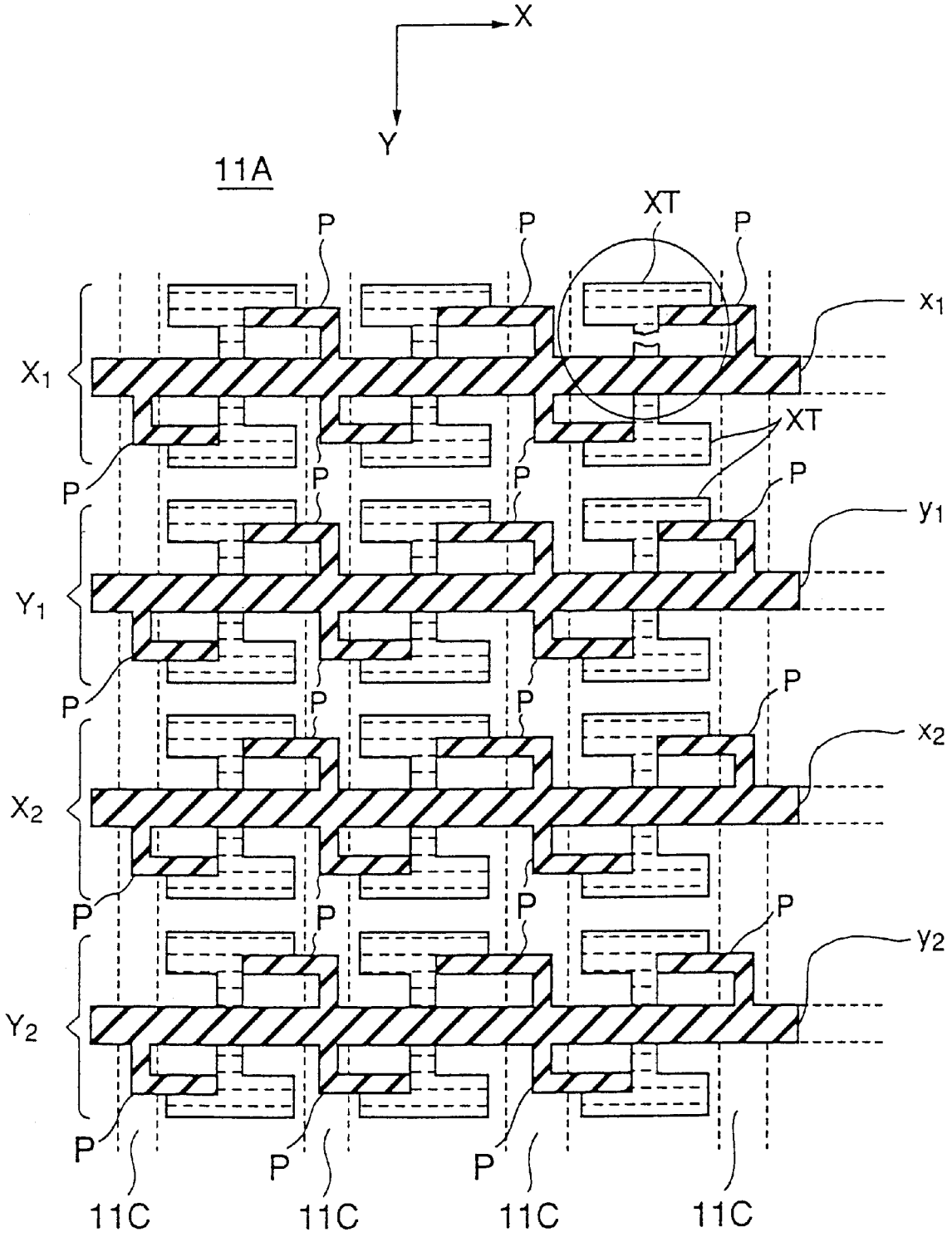
FIG. 5 PRIOR ART
FIG. 5 is a diagram showing a modification of the plasma display device of FIGS. 3(A) and 3(B)

In FIG. 10, the plasma display device 20, which basically has the same structure as that shown in FIG. 5, has display cells C formed, in a matrix-like arrangement, by the T-shaped discharge electrode patterns XT and YT including the auxiliary electrodes P. Display cells Cx formed by the T-shaped discharge electrode patterns XT and YT without the auxiliary electrodes P are dispersively arranged among the display cells C as indicated by circles in FIG. 10.

Figure 7B:
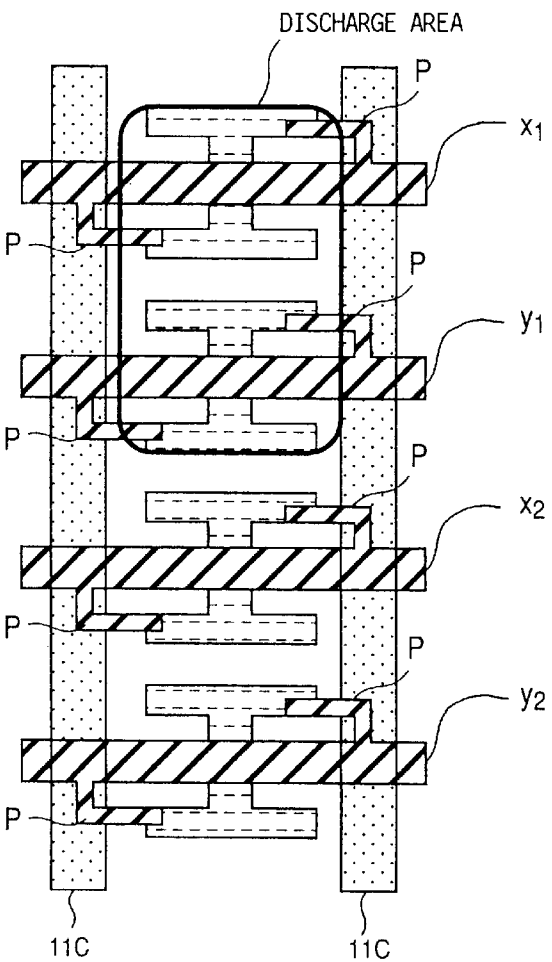
FIG. 7B PRIOR ART
FIGS. 7(A) and 7(B) are diagrams for illustrating a disadvantage of the plasma display device of FIG. 5.
Figure 7A:
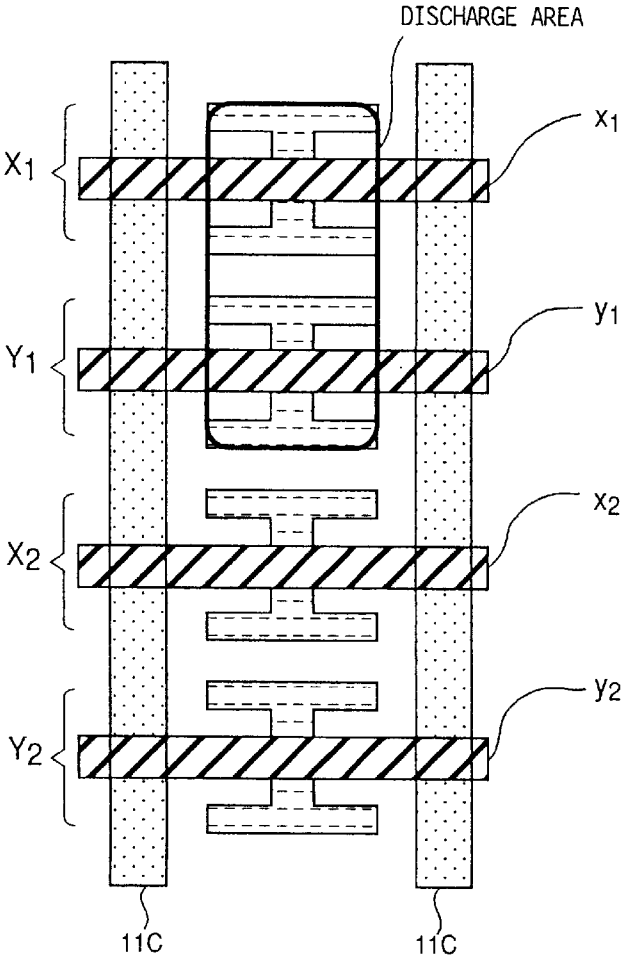
FIG. 7A PRIOR ART

The Display cells Cx are formed so that each of display cell arrays arranged along the ribs 11C includes at least one of the display cells Cx, thereby preventing a giant abnormal discharge caused in any display cell array from spreading from cell to cell along the display cell array. That is, the display cell Cx, which has a smaller discharge area than the display cell C as previously described by referring to FIGS. 7(A) and 7(B), makes it difficult for a discharge to spread along the display cell array beyond the display cell Cx.

On the other hand, since the display cells Cx are formed of the discharge electrode patterns XT and YT without the auxiliary electrodes P, the display cell Cx may cause a display defect. Therefore, if the display cells Cx are formed adjacently, this may cause the display defect to stand out. Thus, as shown in FIG. 10, the display cells Cx are preferably formed apart from one another in both vertical and horizontal directions of FIG. 10 and dispersively arranged evenly among the display cells C.

If the number of the display cells Cx included in the plasma display panel is too small, a giant abnormal discharge cannot be prevented from growing. On the other hand, if the number is too large, a display tends to become darker because of display defects. Therefore, in this embodiment, the preferable number of the display cells Cx is one in every 50 display cells, or discharge cells. Generally, the breakage of the discharge electrode pattern XT or YT as shown in FIG. 5 occurs with a probability of 0.01%. This means that a panel of three million pixels has 300 defective pixels. On the other hand, by providing the auxiliary electrodes P, the number of defective pixels can be reduced to zero. If display cells are formed so that one display cell without the auxiliary electrodes P is included in every 50 display cells as in this embodiment, the number of defective display cells is approximately six, thus causing no practical problem.

Second Embodiment

Figure 11:
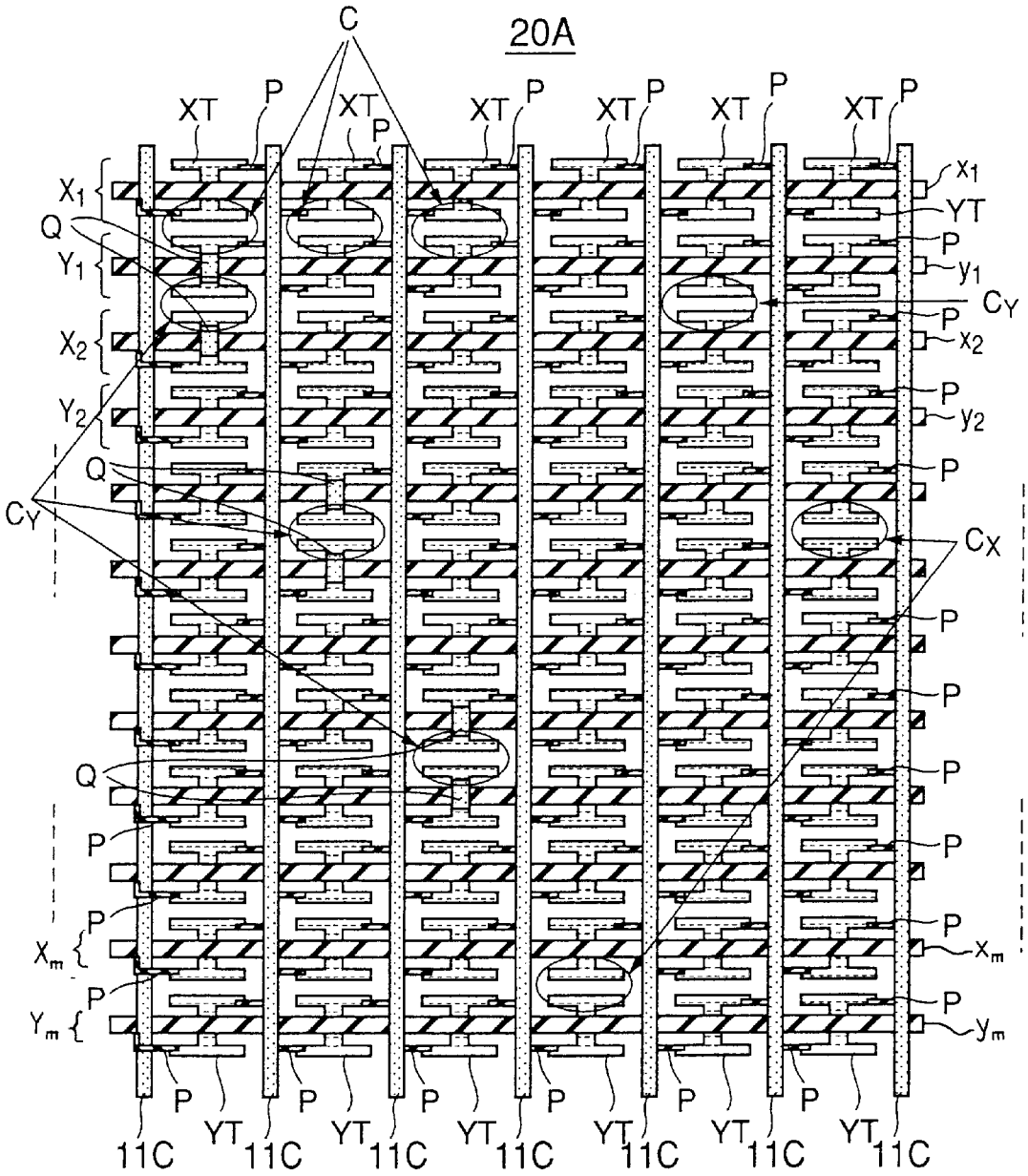
FIG. 11 is a diagram showing a structure of a plasma display device according to a second embodiment of the present invention.

FIG. 11 is a diagram showing a structure of a plasma display device 20A according to a second embodiment of the present invention. In FIG. 11, the same elements as those previously described are referred to by the same numerals, and a description thereof will be omitted.

Figure 1:
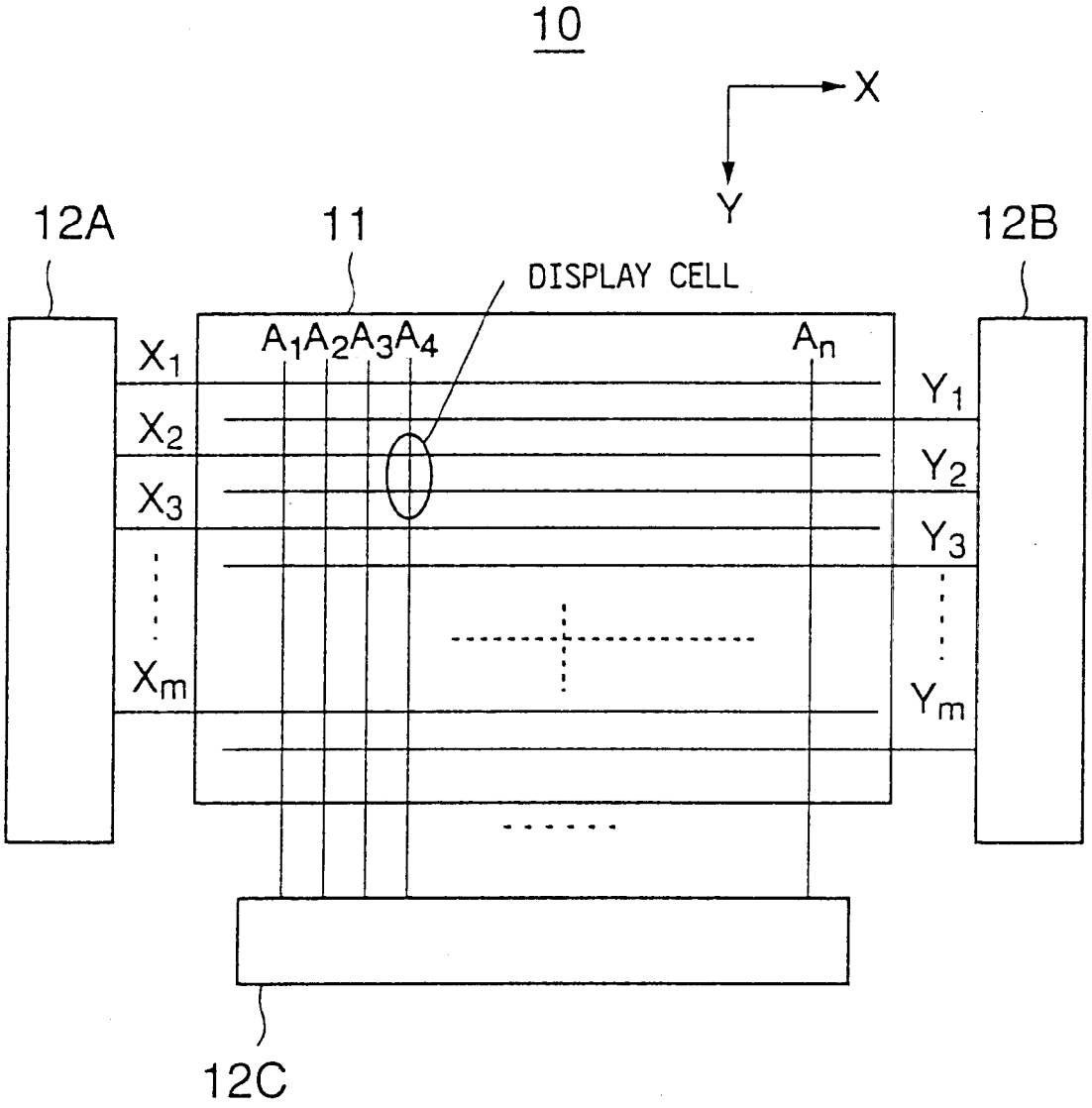
FIG. 1 PRIOR ART
FIG. 1 is a block diagram showing a structure of a conventional plasma display device.
Figure 2:
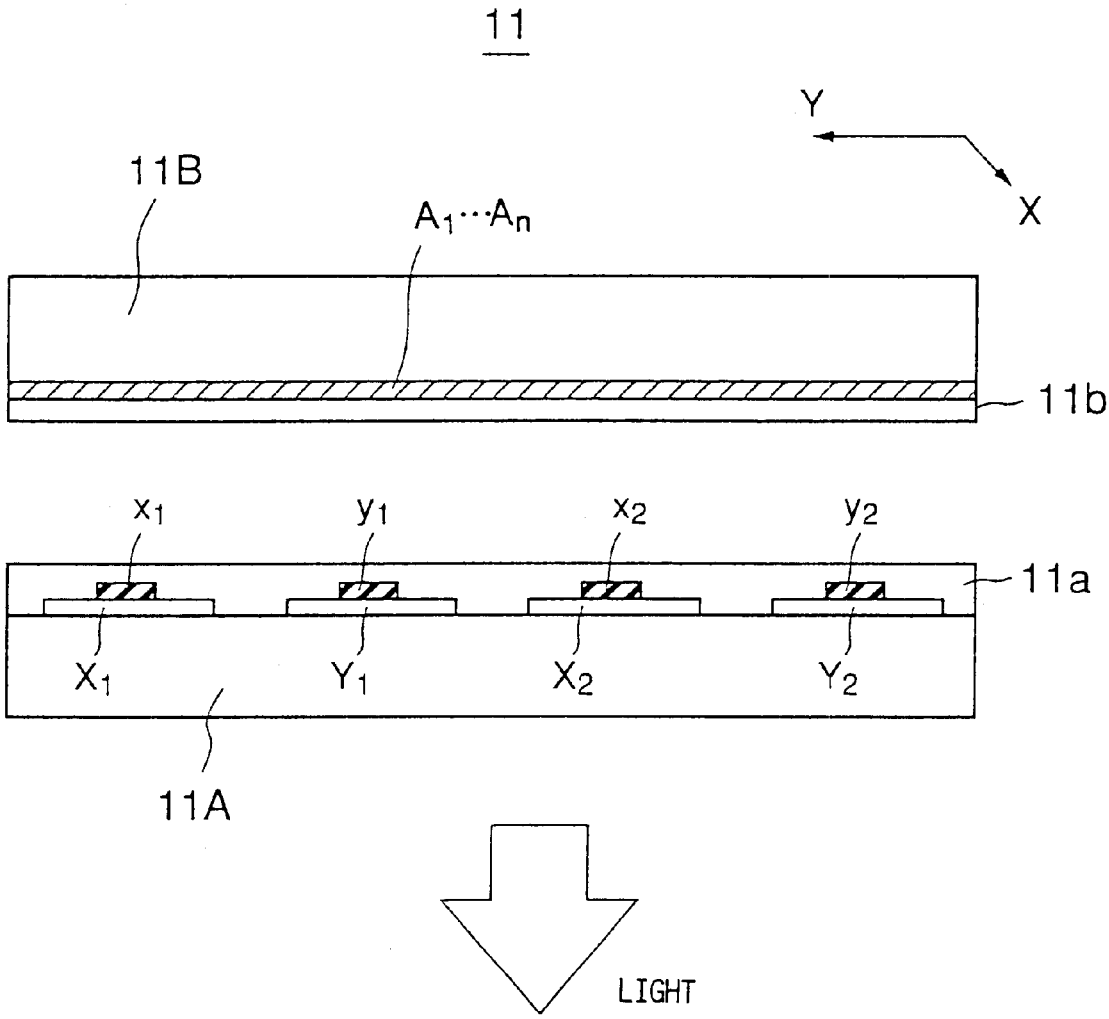
FIG. 2 PRIOR ART
FIG. 2 is a sectional view of a conventional plasma display device by an ALIS driving method.
Figure 3A:
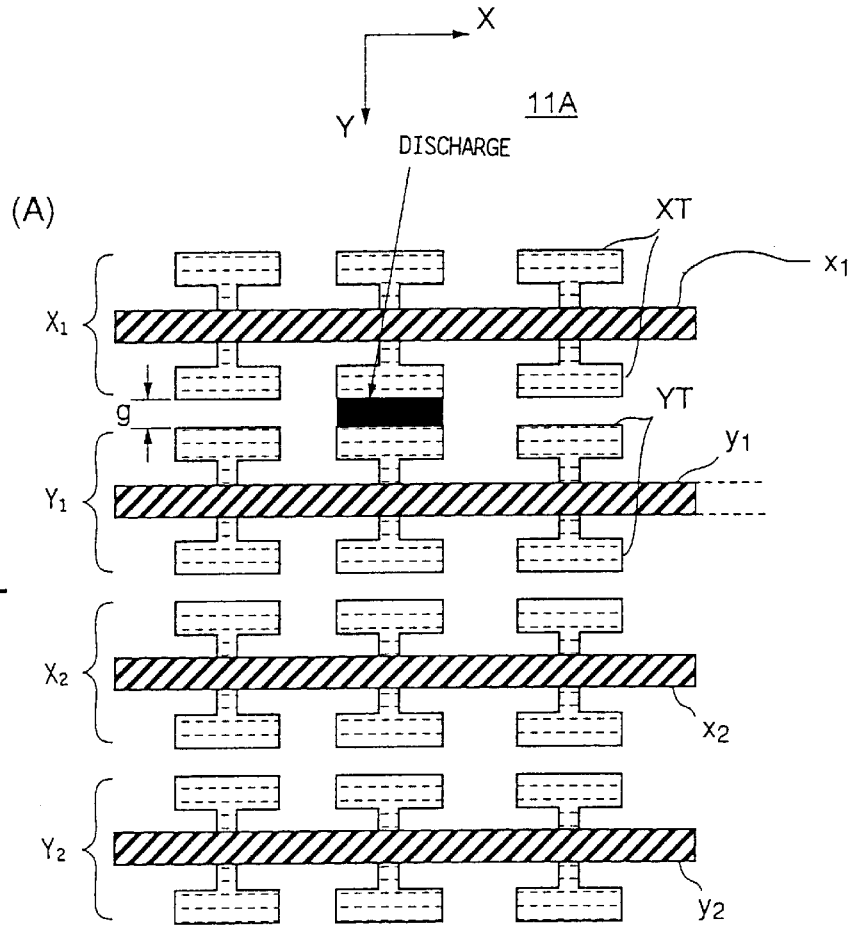
FIG. 3A PRIOR ART
FIGS. 3(A) and 3(B) are diagrams showing an electrode structure of a conventional plasma display device by the ALIS driving method.
Figure 3B:
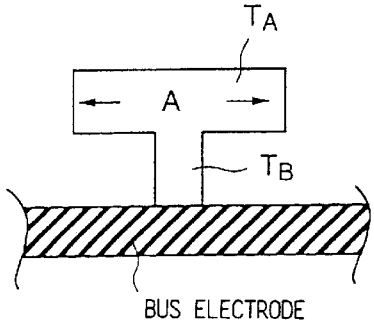
FIG. 3B PRIOR ART
Figure 6:
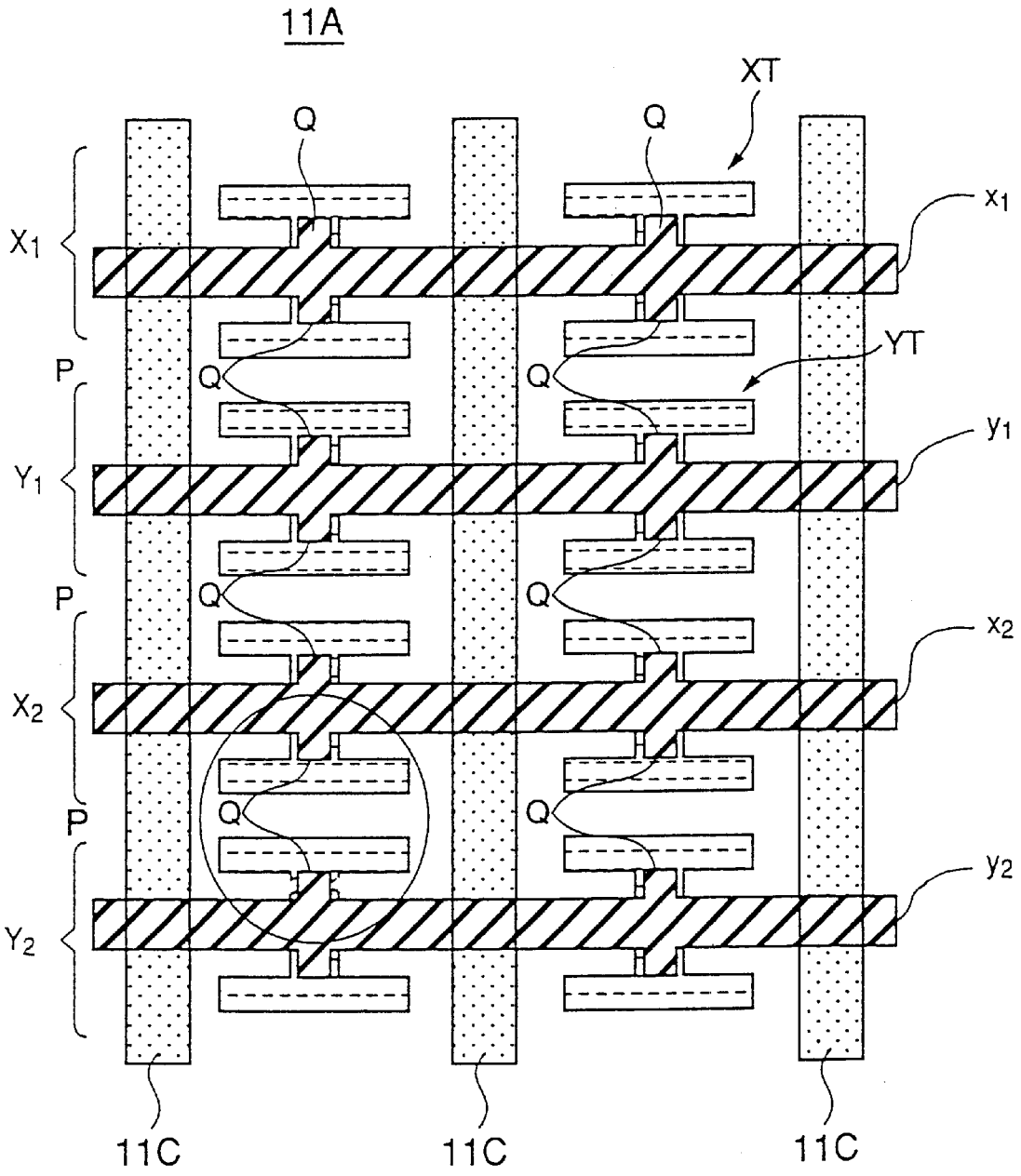
FIG. 6 PRIOR ART
FIG. 6 is a diagram showing another modification of the plasma display device of FIGS. 3(A) and 3(B)

According to FIG. 11, in this embodiment, display cells Cy are formed and evenly arranged among the display cells C arranged in the matrix-like manner instead of the display cells Cx employed in the above-described embodiment. In order to prevent the problem of breakage of the discharge electrode pattern XT or YT which problem pertains to the display cells Cx, the display cells Cy include the auxiliary electrodes Q shown in FIG. 6 instead of the auxiliary electrodes P. As previously described in FIG. 6, the auxiliary electrodes Q stem from the longitudinal sides of the bus electrodes $x_1$ through $x_m$ and $y_1$ through $y_m$ to connect the bus electrodes $x_1$ through $x_m$ and $y_1$ through $y_m$ directly with the tip parts TA (see FIG. 3(B)) of the T-shaped discharge electrode patterns XT and YT correspondingly.

Figure 8:
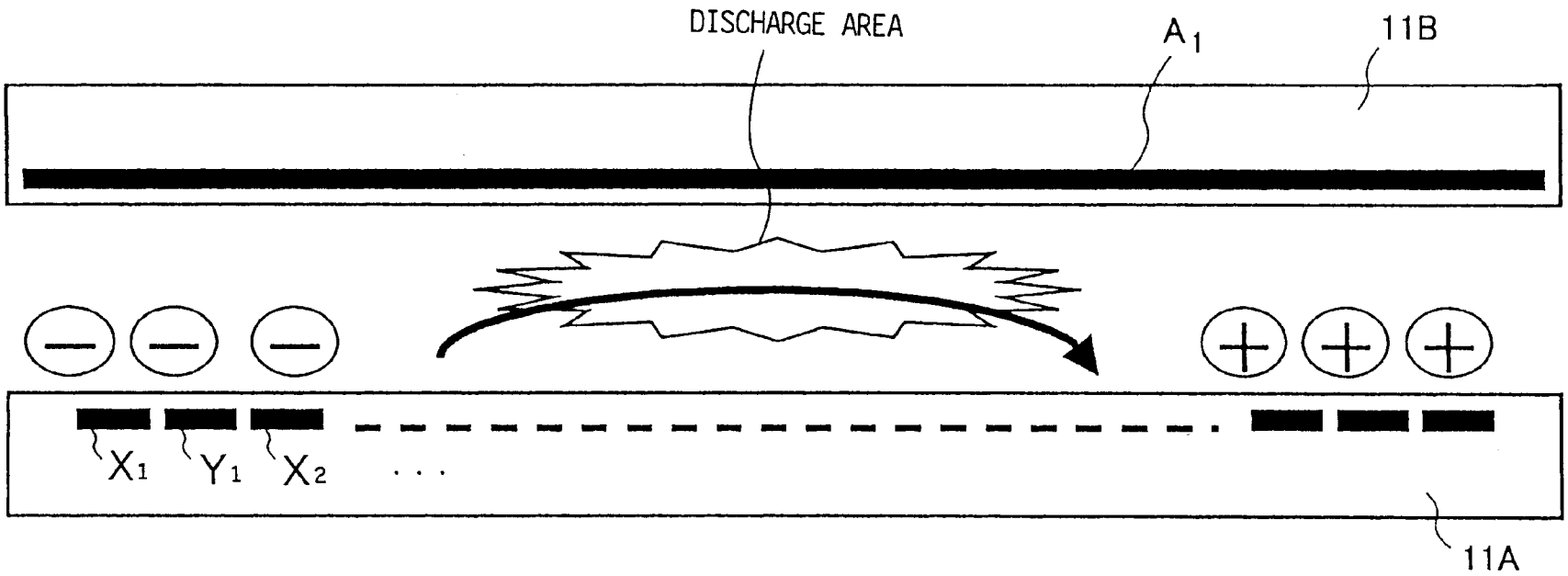
FIG. 8 PRIOR ART
FIG. 8 is a diagram for illustrating the disadvantage of the plasma display device of FIG. 5.

This dispersive formation and arrangement of the display cells Cy having the auxiliary electrodes Q in the display cell arrays also prevents the spread of the giant abnormal discharge described in FIG. 8. This is because the formation of the auxiliary electrodes Q, unlike the formation of the auxiliary electrodes P, does not increase the effective width of the tip part TA of each of the T-shaped discharge electrode pattern XT and YT, thus preventing an increase in a discharge area and, accordingly, a discharge current.

In the structure with the auxiliary electrodes Q, the bus electrodes x1 through xm and y1 and ym are directly connected with the tip parts TA of the T-shaped discharge electrode patterns XT and YT correspondingly. Therefore, even if any of the neck parts TB is broken, a driving voltage continues to be supplied to the corresponding tip part TA, thereby preventing a display defect. On the other hand, as previously described, the structure with the auxiliary electrodes Q, which are formed of opaque metal electrodes, tends to cause a darker display. However, this embodiment employs one display cell Cy approximately in every 50 display cells, thus preventing a serious decrease in display brightness.

It is preferable also in this embodiment that each of the display cell arrays arranged along the ribs 11C includes at least one of the display cells Cy among the display cells arranged in the matrix-like manner in the plasma display panel formed of the front and rear glass substrates 11A and 11B. Further, as shown in FIG. 11, it is also possible for the plasma display panel to include the above-described display cells Cx and the display cells Cy at the same time.

Third Embodiment

Figure 12:
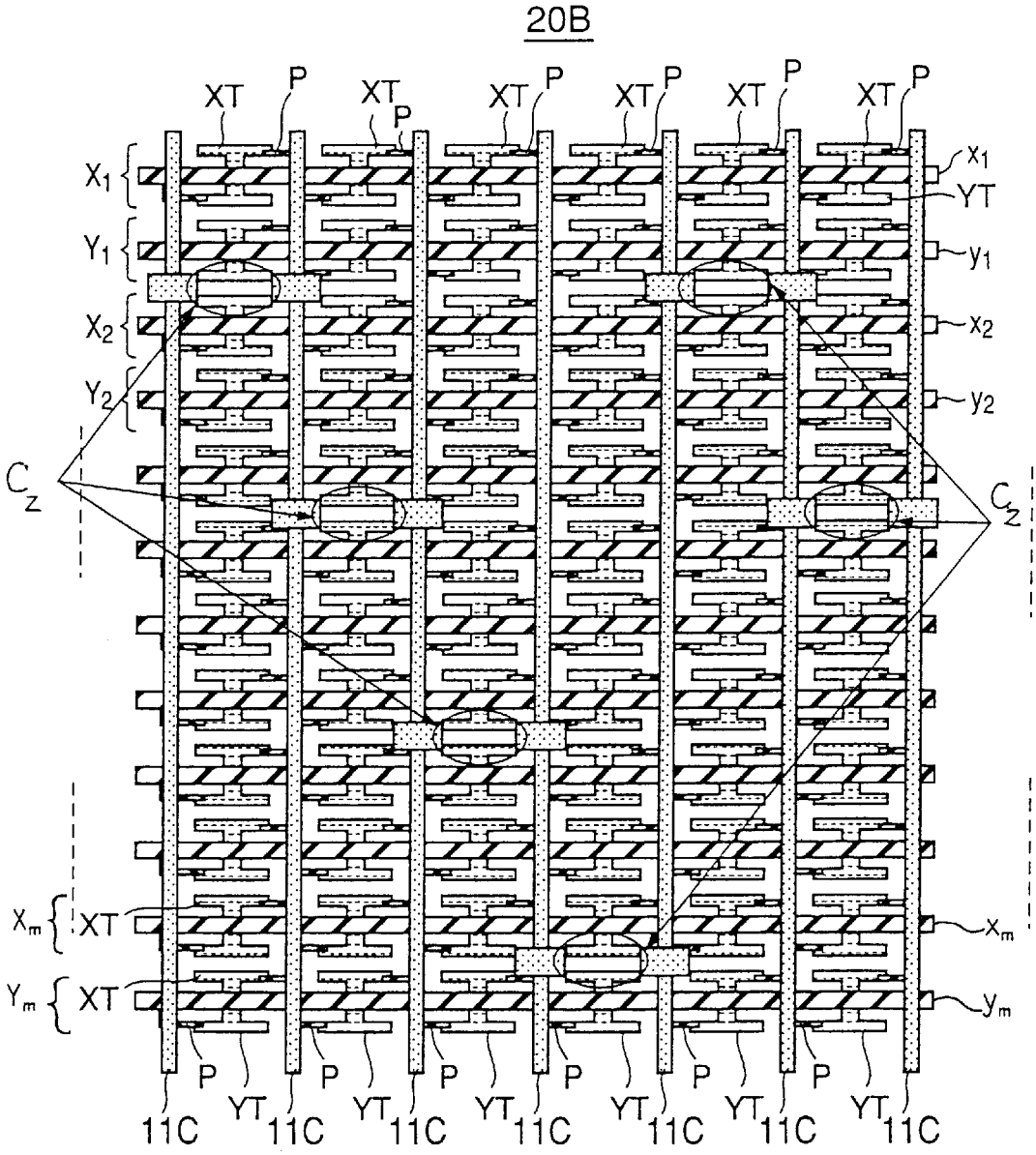
FIG. 12 is a diagram showing a structure of a plasma display device according to a third embodiment of the present invention.

FIG. 12 is a diagram showing a structure of a plasma display device 20B according to a third embodiment of the present invention.

Figure 9:
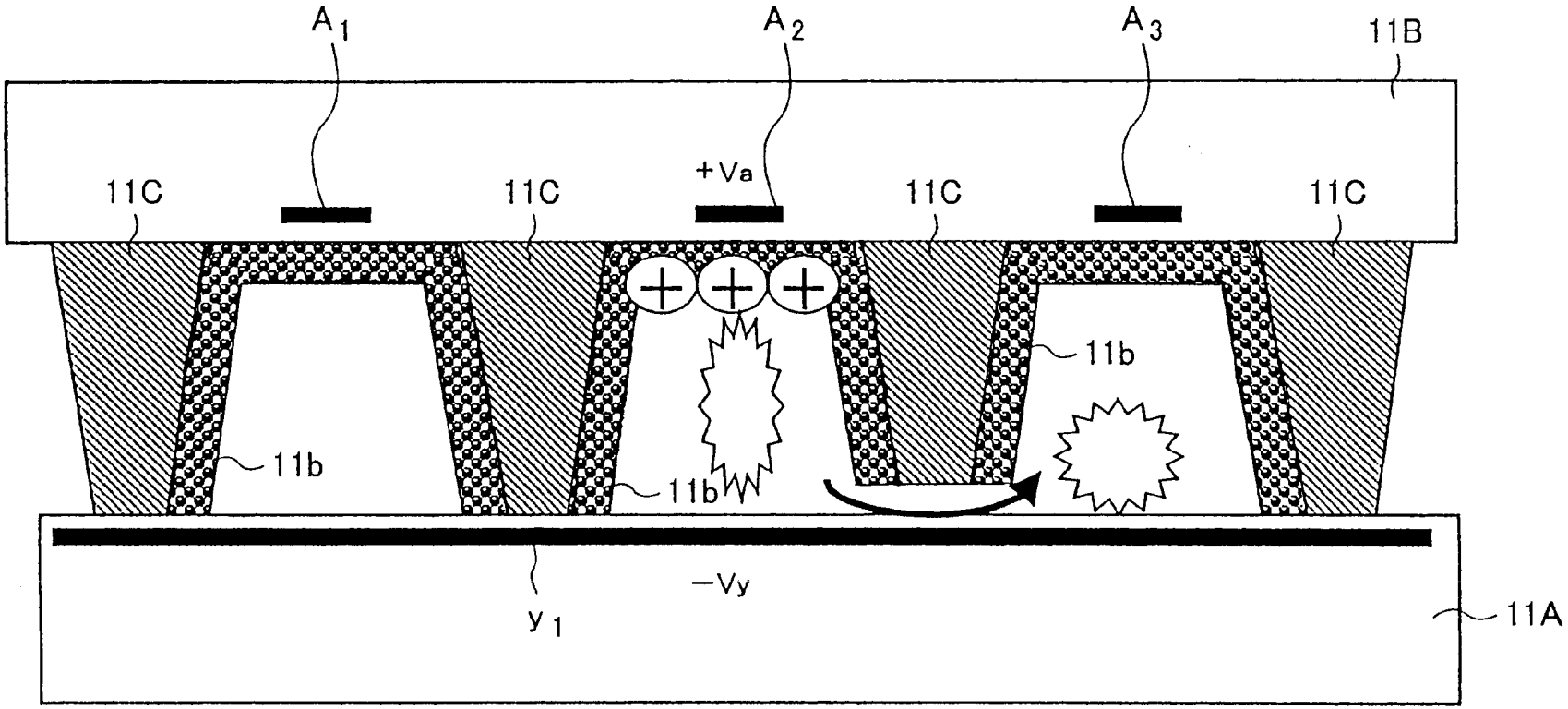
FIG. 9 PRIOR ART
FIG. 9 is a diagram for illustrating the disadvantage of the plasma display device of FIG. 5.

According to FIG. 12, the plasma display device 20B basically has an electrode structure with the auxiliary electrodes P shown in FIG. 5 formed on the glass substrates 11A and 11B. In order to solve the problem of the movements of charges beyond the ribs 11C and a consequent abnormal discharge described in FIG. 9, the plasma display device 20B includes display cells Cz, where the ribs 11C have their thicknesses increased.

Particularly in the structure of FIG. 12, each display cell Cz is partitioned by the ribs 11C both having their thicknesses increased. This structure prevents charges from moving beyond the display cell Cz and the ribs 11C partitioning the display cell Cz into neighboring display cell arrays, thus preventing an abnormal discharge.

Fourth Embodiment

Figure 13:
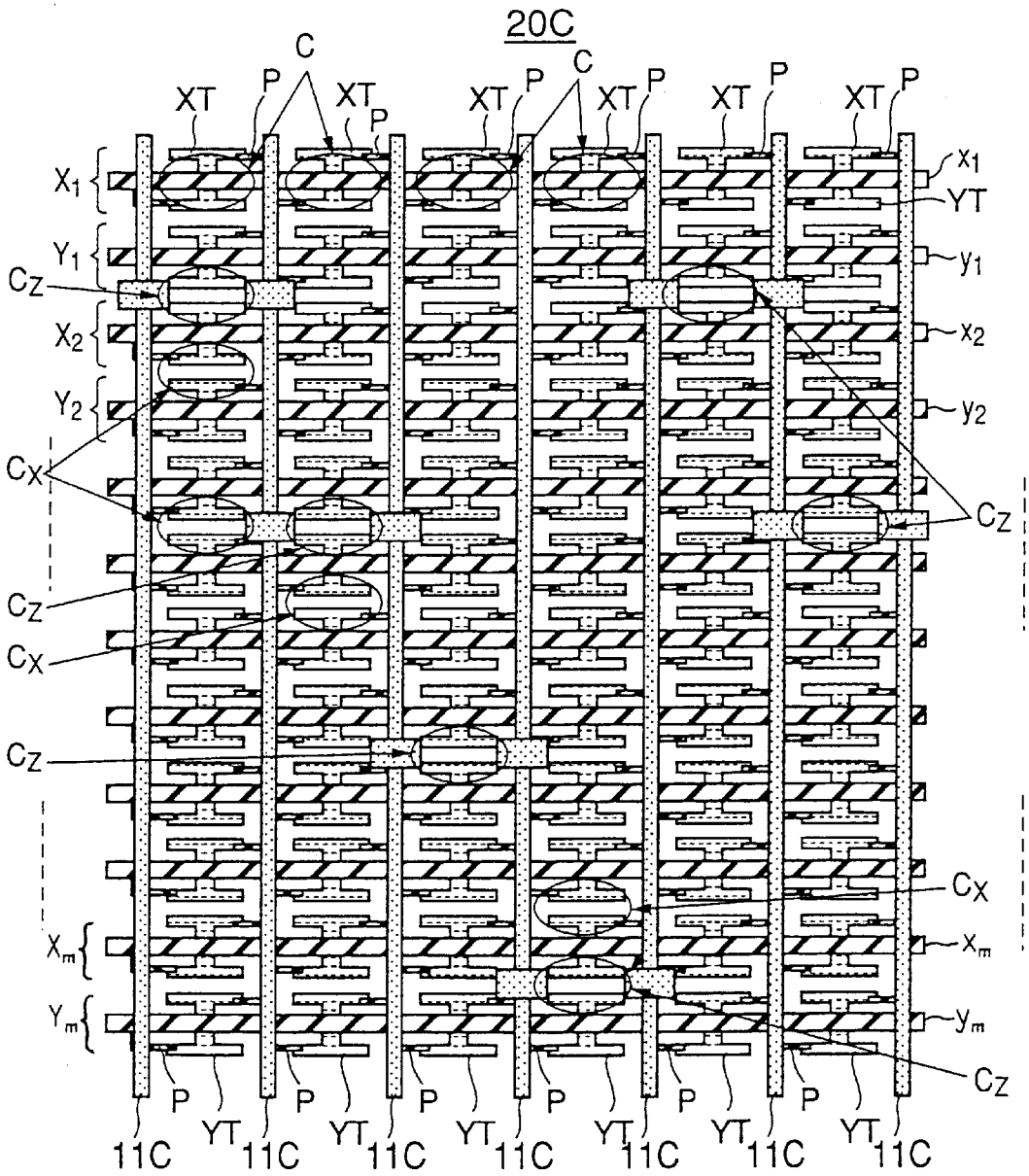
FIG. 13 is a diagram showing a structure of a plasma display device according to a fourth embodiment of the present invention.

FIG. 13 is a diagram showing a structure of a plasma display device 20C according to a fourth embodiment of the present invention.

According to FIG. 13, the plasma display device 20C is structurally a combination of the above-described plasma display devices 20 and 20B. That is, in addition to the normal display cells C having the auxiliary electrodes P, the plasma display device 20C has the display cells Cx, which are not provided with the auxiliary electrodes P, and the display cells Cz, where the ribs 11C have their thicknesses increased, formed to be dispersed evenly on the front glass substrate 11A.

This structure prevents a giant abnormal discharge from spreading along and across the ribs 11C by the display cells Cx and Cz, respectively.

In this embodiment, although each display cell Cx eliminates only one of the auxiliary electrodes P as shown in FIG. 13, this structure is also effective in preventing the giant abnormal discharge from spreading along the ribs 11C.

Further, in this embodiment, the display cells Cx may be replaced by the display cells Cy with the auxiliary electrodes Q previously described in FIG. 11.

Fifth Embodiment

Figure 14:
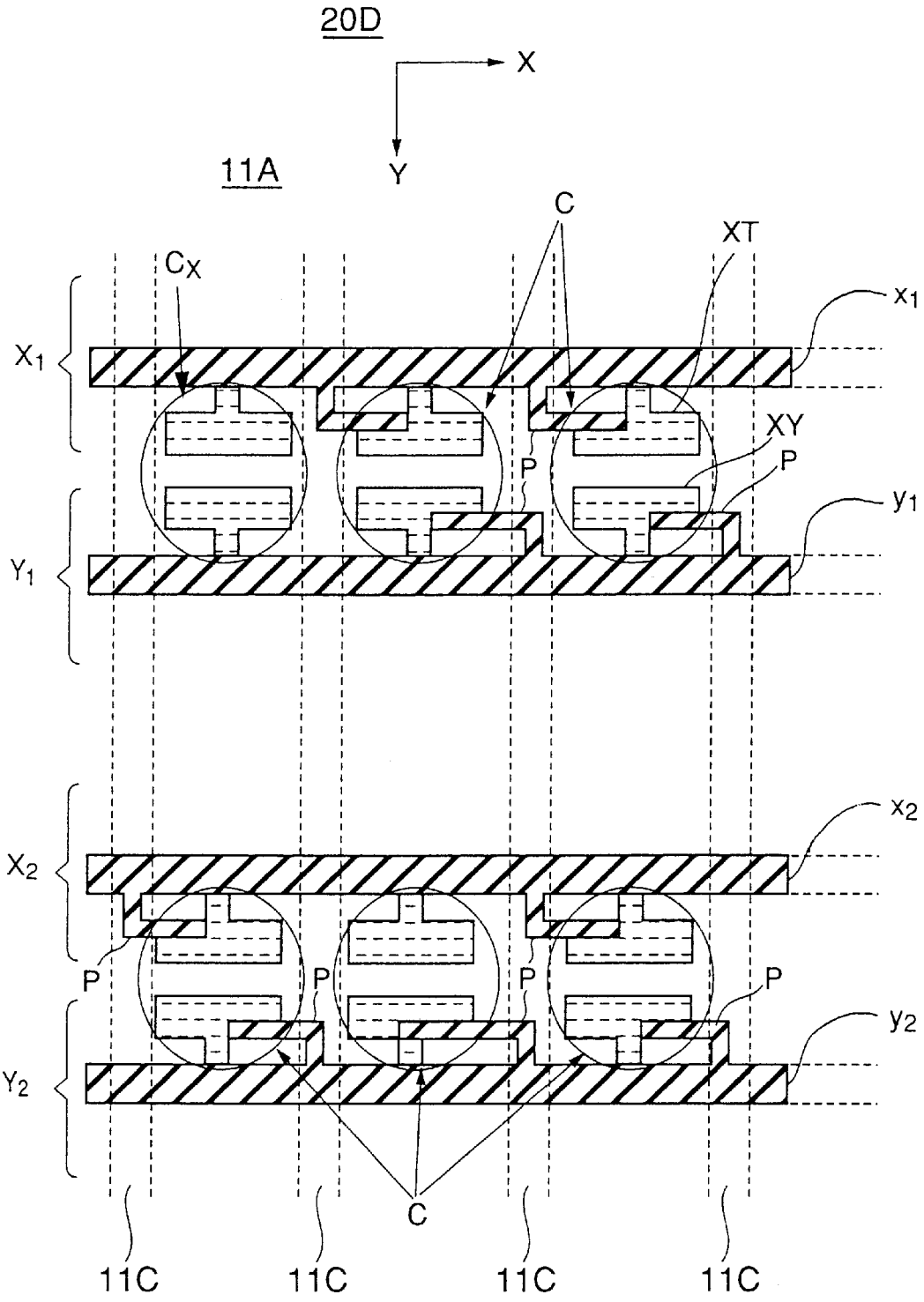
FIG. 14 is a diagram showing a structure of a plasma display device according to a fifth embodiment of the present invention.

FIG. 14 is a diagram showing a plasma display device 20D according to a fifth embodiment of the present invention. In FIG. 14, the same elements as those previously described are referred to by the same numerals, and a description thereof will be omitted.

The above-described display cell structure partially formed by the display cells Cx and Cy, that is, the display cells without the auxiliary electrodes P and with the auxiliary electrodes Q, is effective in the prevention of the spread of the giant abnormal discharge not only in the above-described plasma display device by the ALIS driving method but also in the plasma display device 20D by a normal driving method. In the plasma display device 20D, corresponding discharge electrodes forming a pair, that is, the first and second discharge electrodes X1 and Y1, X2 and Y2, . . . , are arranged close to each other as shown in FIG. 14.

FIG. 14 shows that the display cells Cx are formed among the display cells C in this embodiment. The display cells Cy may replace the display cells Cx, and both display cells Cx and Cy may be included in the plasma display device 20D. Further, the display cells Cz described previously in FIG. 14 may also be formed.

The present invention is not limited to the specifically disclosed embodiments, but variations and modifications may be made without departing from the scope of the present invention.

The present application is based on Japanese priority application No. 2000-341095 filed on Nov. 8, 2000, the entire contents of which are hereby incorporated by reference.

What is claimed is:

1. A plasma display device comprising:

first and second substrates sandwiching a discharge gas therebetween;

a plurality of first and second electrodes arranged alternately on the first substrate to extend in a first direction;

a plurality of third electrodes arranged on the second substrate to extend in a second direction perpendicular to the first direction;

display cells formed between the first and second electrodes along the third electrodes;

first and second discharge electrode parts extending from the first and second electrodes toward the second and first electrodes in the display cells, respectively; and first and second auxiliary electrodes connecting the first and second electrodes with tip parts of the first and second discharge electrode parts, respectively, wherein the display cells include first and second display cells, the first display cells including the first and second auxiliary electrodes, the second display cells each lacking at least one of the first and second auxiliary electrodes.

2. The plasma display device as claimed in claim 1, wherein each of the second display cells lacks both of the first and second auxiliary electrodes.

3. The plasma display device as claimed in claim 1, wherein:

the first and second electrodes include low-resistance bus electrodes;

the first and second discharge electrode parts include neck parts connecting the first and second discharge electrodes and the tip parts, the first and second discharge electrode parts being formed of transparent electrodes extending from the first and second electrodes, respectively;

the first and second auxiliary electrodes are formed of the low-resistance bus electrodes; and third and fourth auxiliary electrodes are formed of the low-resistance bus electrodes in layers on the neck parts of the first and second discharge electrode parts, respectively, in the second display cells.

4. The plasma display device as claimed in claim 1, wherein the second display cells account for 10 percent or less of the display cells.

5. The plasma display device as claimed in claim 1, wherein each array of the display cells in the second direction includes at least one of the second display cells.

6. The plasma display device as claimed in claim 1, wherein the second display cells are prevented from being adjacent to one another in each array of the display cells in the second direction.

7. The plasma display device as claimed in claim 1, wherein the second display cells are prevented from being adjacent to one another in each array of the display cells in the first direction.

8. The plasma display device as claimed in claim 1, further comprising partition walls formed on the second substrate and separating arrays of the display cells in the second direction from one another, the partition walls having thicknesses thereof increased in specified ones of the display cells, wherein the third electrodes are formed in spaces partitioned by the partition walls.

9. A plasma display device comprising:

first and second substrates sandwiching a discharge gas therebetween;

a plurality of first and second electrodes arranged alternately on the first substrate to extend in a first direction;

a plurality of third electrodes arranged on the second substrate to extend in a second direction perpendicular to the first direction;

display cells formed between the first and second electrodes along the third electrodes;

first and second discharge electrode parts extending from the first and second electrodes toward the second and first electrodes in the display cells, respectively;

first and second auxiliary electrodes connecting the first and second electrodes with tip parts of the first and second discharge electrode parts, respectively; and partition walls formed on the second substrate and separating arrays of the display cells in the second direction from one another, the partition walls having thicknesses thereof increased in specified ones of the display cells, wherein:

the display cells include first and second display cells, the first display cells including the fill first and second auxiliary electrodes, the second display cells each lacking at least one of the first and second auxiliary electrodes; and the third electrodes are formed in spaces partitioned by the partition walls.

* * * * *